United States Patent [19]

Vogel

[11] Patent Number: 4,787,318

[45] Date of Patent: Nov. 29, 1988

[54] TRACTION BOGIE FOR A RAIL VEHICLE

[75] Inventor: Hans H. Vogel, Tuttwil, Switzerland

[73] Assignee: Schweizerische Lokomotiv-und Maschinenfabrik, Winterthur, Switzerland

[21] Appl. No.: 14,795

[22] Filed: Feb. 13, 1987

[30] Foreign Application Priority Data

Feb. 27, 1986 [CH] Switzerland ..... 803/86

[51] Int. Cl.[4] ..... B61B 3/06

[52] U.S. Cl. ..... 105/136; 105/167; 105/176

[58] Field of Search ..... 105/136, 167, 168, 171, 105/176, 190.2, 197.05, 201, 228

[56] References Cited

U.S. PATENT DOCUMENTS

| | | | |
|---|---|---|---|
| 4,134,343 | 1/1979 | Jackson | 105/167 |
| 4,167,906 | 9/1979 | Steinmann et al. | 105/136 |
| 4,337,706 | 7/1982 | Loosli | 105/136 |
| 4,353,309 | 10/1982 | Pollard et al. | 105/136 |
| 4,411,202 | 10/1983 | Kreissig | 105/136 |
| 4,679,507 | 7/1987 | Rassaian | 105/136 |

*Primary Examiner*—Sherman D. Basinger
*Assistant Examiner*—Stephen P. Avila
*Attorney, Agent, or Firm*—Kenyon & Kenyon

[57] ABSTRACT

The traction bogie comprises two wheel sets each coupled with a traction motor. The bogie frame is mounted resiliently on the wheel sets with provision for movement at least lengthwise of the bogie. Each of the casings of the traction motors is carried on the associated wheel set and is connected to the bogie frame to be movable in three dimensions. Also, each casing is connected to the bogie frame by way of two links which are adapted to transmit traction and braking forces and which are articulated to the bogie frame and to the casing to be pivotable around substantially vertical axes. The links are so disposed that their longitudinal axes converge and the imaginary extensions of the longitudinal axes intersect one another at an intersection point disposed in the vicinity of the wheel set and casing. The intersection point determines the position of an imaginary vertical rotational axis around which the wheel set and the associated traction motor can pivot relatively to the bogie frame.

17 Claims, 5 Drawing Sheets

TRACTION BOGIE FOR A RAIL VEHICLE

This invention relates to a traction bogie for a rail vehicle.

Heretofore, various types of traction bogies have been known for rail vehicles. In some cases, the bogie has been constructed of a bogie frame and at least two wheel sets each of which is coupled with a traction motor. Also, in some cases, the bogie frames have been resiliently carried on the wheel sets by way of axle boxes and have been guided so as to be movable at least lengthwise of the bogie. Likewise, the traction motor has been provided with a casing which is carried on the associated wheel set and which is connected to the bogie frame by way of an articulation device which is adapted to transmit traction and braking forces while also being pivotable about a substantially vertical axis.

As described in U.S. Pat. No. 4,167,906, a traction motor can be articulated to the bogie frame by means of a rigid drawbar-like connecting member which extends in a longitudinal direction so that the traction motor is pivotable about a longitudinally and transversely stationary axis while being guided with provision for longitudinal movement by a second connecting member which extends in the opposite longitudinal direction and which is adapted to transmit transverse forces. In order to enable the axles to take up a substantially radial position when a rail vehicle negotiates a curve, an adjusting facility is also provided which enables the axles to pivot around the pivot by way of which the connecting member transmitting the traction and braking forces is articulated to a support of the bogie frame.

Bogies which are constructed in the above manner are relatively complex and require various control facilities in order to adjust the wheel sets radially of a curved track. In addition, the adjusting facilities are generally actuated independently in order to dispose the wheel sets radially of the curved track.

Accordingly, it is an object of the invention to provide a traction bogie of simplified construction having wheel sets which automatically adjust themselves on curves to be positioned substantially radially to the curves.

It is another object of the invention to automatically adjust the wheel sets of a traction bogie to a curve without the need for added control facilities.

It is another object of the invention to provide a relatively simple construction for adjusting the wheel sets of a rail bogie to the curvature of a track.

Briefly, the invention provides a traction bogie for a rail vehicle which is comprised of at least two wheel sets each of which has a axle, a plurality of axle boxes, each of which is disposed at a respective end of an axle and a bogie frame which is resiliently mounted on the axle boxes for movement at least lengthwise of the bogie. In addition, a casing is mounted on each axle with means therein for transmitting a driving force to the axle. Also, an articulated linkage connects each casing to the bogie frame in order to transmit a driving force from a wheel set to the bogie frame.

In accordance with the invention, each articulated linkage includes at least a pair of links on opposite sides of a longitudinal axis of the bogie frame and disposed in converging relation to each other towards a wheel set. The links of each pair also have the imaginary extensions of the longitudinal axis of each link thereof intersecting each other at an imaginary point of intersection which is disposed in the vicinity of a wheel set and the casing thereon. Each link is also articulated at one end to the bogie frame and at an opposite end to a respective casing for pivoting about a vertical axis.

The link pairs form a longitudinally substantially rigid connection between the bogie frame and each of the wheel sets so that the driving forces, i.e. the traction and braking forces, of each wheel set are transmitted directly to the bogie frame at the respective points of intersection. Further, the points of intersection can be used to determine an imaginary substantially vertical axis of rotation around which the unit formed by the corresponding wheel set and associated casing can pivot relative to the bogie frame. The differences in tractive effort which arise on curves between the left and right wheels of a wheel set can be used, within the limits set by the resilient mounting of the bogie frame on the axles and particularly of the lateral axle boxes, to rotate each wheel set around its imaginary vertical axis of rotation.

In one embodiment which is capable of providing very good running characteristics, particularly, quiet running of the traction bogie on curves, each axle box can be movingly coupled with the bogie frame by way of a guide member which is articulated to the bogie frame about a horizontal axis in a transverse plane parallel to and spaced from an axle of a wheel set. In addition, the point of intersection of the converging links to the casing can be disposed between this transverse plane and a longitudinal axis of the associated axle of the wheel set. In this respect, the point of intersection can be disposed directly on the axis of the axle or near the transverse plane or at any point between these two boundaries.

In constructions of the above type, particularly those having an axle which is mounted in a traction motor casing so as to be axially immobile, the wheel sets respond to transverse forces which arise when the vehicle negotiates curves by pivoting around the corresponding imaginary vehicle axis of rotation in the manner of a pony truck.

In constructions where the point of intersection of the links of an articulated linkage is disposed near the axle of the wheel set, particularly where the axles are mounted on casings with a provision for axial movement, the axial movement between the casing and the axle can be substantially reduced.

In constructions where the point of intersection is disposed in the transverse plane extending through the horizontal axis on which the guide members are mounted on the bogie frame, and thus through the transverse support between the wheel set concerned and the bogie frame,,and particularly in conjunction with helical gearing and with lateral axle boxes so guided as to be movable lengthwise of the vehicle, unwanted lurching movements of the wheel set relative to the bogie frame such as are caused by tooth forces are eliminated.

In another embodiment, particularly useful for negotiating narrow curves, the traction motor casings can be interconnected by a cross-coupling which, in response to a movement of one casing around an imaginary vertical axis passing through the point of intersection of the articulated linkage, produces a corresponding movement in an opposite sense of the other casing around the imaginary vehicle axis thereof. The relatively close together axles which are thus coupled together and each takes up a substantially radial position to the curve relatively easily because of the reduced angular differences.

These and other objects and advantages of the invention will become more apparent from the following detailed description taken in conjunction with the accompanying drawings wherein.

Figure 1:
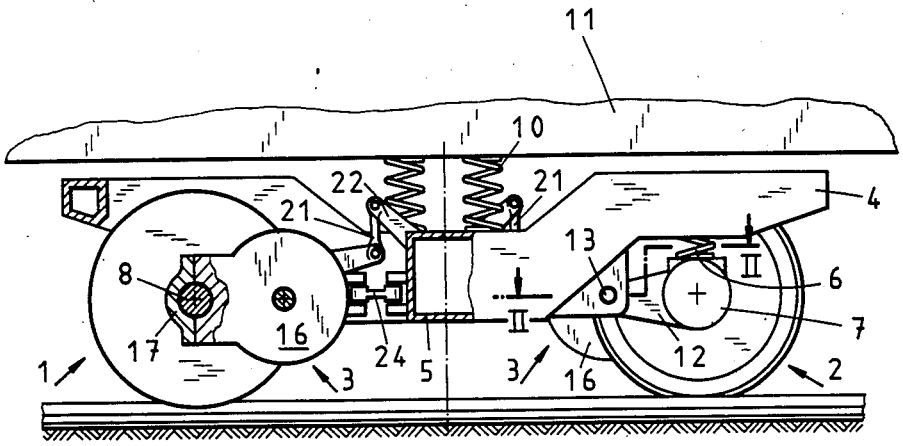
FIG. 1 illustrates a partial elevational view taken on line I—I of FIG. 2 of a traction bogie constructed in accordance with the invention.
Figure 2:
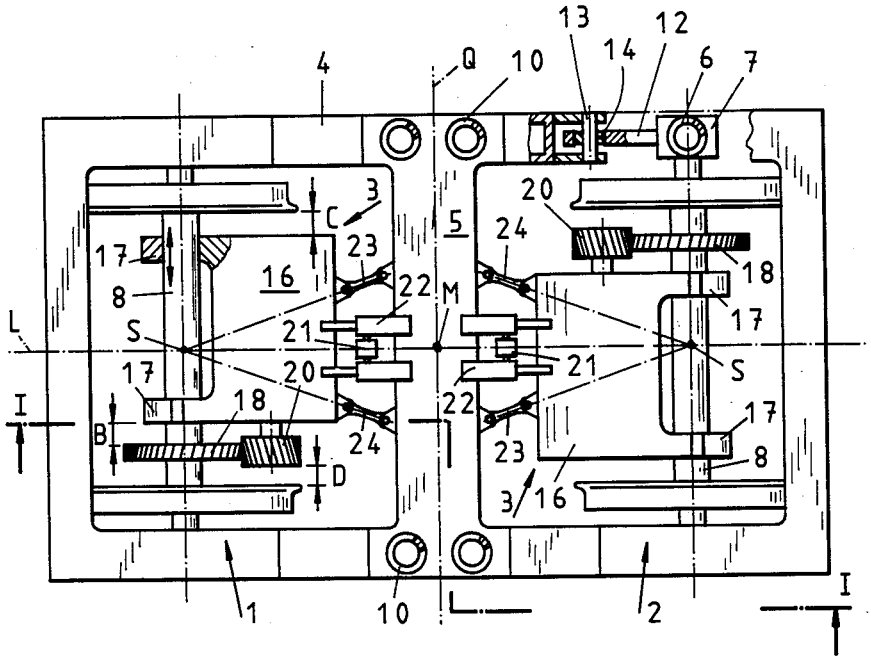
FIG. 2 illustrates a plan view of the traction bogie of FIG. 1 with a partial section taken on line II—II of FIG. 1.

Referring to FIGS. 1 and 2, the traction bogie has a pair of wheel sets 1, 2 each of which has a pair of wheels connected by a common axle 8. In addition, a traction motor 3 is mounted on each axle 8 and has means therein for transmitting a traction force to the axle 8. In this respect, the casing 3 includes a traction motor of known construction.

The bogie also has a bogie frame 4 which is subdivided by a bolster 5 and which is resiliently mounted via springs 6 on four axle boxes 7 which are mounted on the respective ends of the axles 8.

A part of a vehicle body 11 is carried by way of lateral springs 10 on the bogie frame 4 and is connected thereto by means (not shown) for transmitting traction and braking forces, for example a pivot which is disposed on the bolster 5 at the center M of the bogie or a low-level traction device.

A plurality of guide members 12 are provided for coupling the axle boxes 7 to the bogie frame 4. Each guide member 12 is in the form of a swing arm which extends towards a transverse center-plane Q of the bogie frame 4. Further, each guide member 12 is connected at one end to an axle box 7 and is articulated to the bogie frame by a transverse pivot pin 13 disposed on a horizontal axis in a transverse plane parallel to and spaced from a respective axle 8. As shown in FIG. 2, an intermediate member 14 of an elastomeric material, for example of silicone rubber extends around each pin 13 so that the guide member 12 is mounted on the pin 13 so as to be movable in three dimensions while being resiliently mounted lengthwise and transversely of the bogie frame 4. Correspondingly, no traction and braking forces are transmitted by way of the axle boxes 7. Instead, the axle boxes 7 merely transmit reduced transverse forces which result from the resilient transverse mounting on the pivot end 13 to the bogie frame 4.

Each traction motor 3 has a casing 16 which is carried on the corresponding axle 8 by way of two bearings 17. In addition, a gear 18 is disposed on each axle 8 and meshes with a pinion 20 of the motor (see FIG. 2). As indicated, the gears 18 and pinions 20 can cooperate by way of helical gearing and the axles 8 can be disposed in the bearings 17 and in the gears 18 so as to be movable axially, i.e. transversely of the bogie frame 4. Also, each casing 16 is articulated to a pendulum hanger 21 disposed in the longitudinal center plane L of the bogie frame 4 so as to be pivotable in three dimensions around a transverse axis. Each hanger 21 is also articulated to brackets 22 disposed on the bolster 5 so as to be pivotal in three dimensions.

A pair of articulated linkages are provided to connect the casing 16 to the bogie frame 4 in order to transmit traction and braking forces from the wheel sets 1, 2 to the bogie frame 4. As illustrated particularly in FIG. 2, each linkage includes a pair of links 23, 24 on opposite sides of the longitudinal axis or plane L of the bogie frame 4 in symmetric relation. Further, the links 23, 24 converge relative to each other from the bolster 5 towards the respective casing 16. Each link 23, 24 is articulated to the bolster 5 of the bogie frame 4 and at an opposite end to a respective casing 16 for pivoting around a vertical pivot axis of a vertical pivot pin.

The imaginary extensions of the longitudinal axes of each link pair 23, 24 intersect one another at an imaginary intersection point S disposed on or substantially on the longitudinal axis of the particular axle 8 concerned.

At places where the hangers 21 and, if required, the links 23, 24 are articulated to the motor casing 16 and the bolster 5 of the bogie frame 4, the pivotally interconnected parts may have spherical bearing surfaces and/or so cooperate with one another by way of resilient bearing members, for example corresponding to the intermediate members 14, as to be movable in three dimensions.

As indicated in FIG. 1, the articulated linkages 23, 24 are disposed in a common horizontal plane with a respective axle 8 of an adjacent wheel set 1,2. In addition, the pivot pins 13 of the guide members 12 are disposed in the same plane.

Each point of intersection S determines an imaginary vertical axis of rotation around which the unit comprising a wheel set 1, 2 and associated motor 3 can pivot relative to the bogie frame 4 when the rail vehicle is negotiating a curve. The axle boxes 7 can be axially immobile on the axles 8 and can be so retained by the spring 6 and by the resilient mounting by way of the pivot pins 13 as to be mobile lengthwise and transversely of the bogie and vertically relative to the bogie. In the arrangement illustrated in FIG. 2, and in which the imaginary vertical axes extend through the axles 8, relative axial movements between the cooperating elements is very reduced. Consequently, substantially reduced clearances B and C are provided between the motor 3 and gears 18 and pinions 20 or one wheel of the wheel set 1, 2 concerned. Likewise, a correspondingly reduced clearance D is provided between the gear 18 and pinion 20 and the other wheel of the wheel set 1, 2, respectively.

Figure 3:
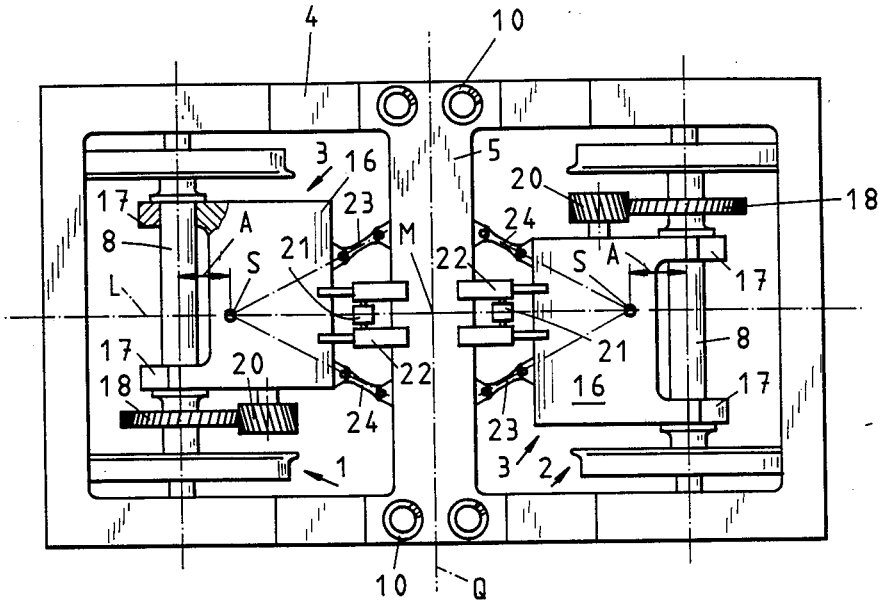
FIG. 3 illustrates a plan view of a modified embodiment of a traction bogie constructed in accordance with the invention.

Referring to FIG. 3, wherein like reference characters indicate like parts as above, the axles 8 can be mounted in the bearings 17 of the casing 16 so as to be axially immobile. In this case, the wheel sets 1, 2 respond to transverse forces such as arise on curves, by pivoting around the imaginary axis passing through the point of intersection S in the manner of a pony truck. Within the constructional limits posed by the construction of the spring 6 and of the pivot pins 13 of the guide members 12, the points of intersection S can be disposed at any distance A from the axis of the corresponding axle 8.

Figure 4:
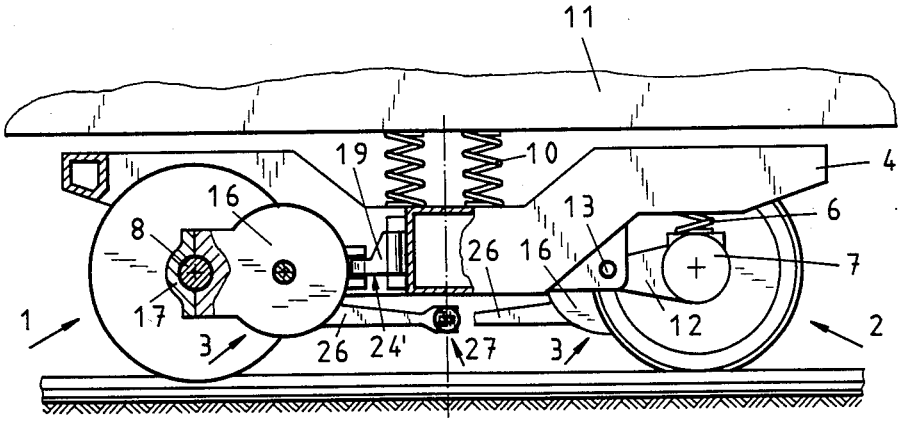
FIG. 4 illustrates a view taken on line IV—IV of a further modified bogie constructed in accordance with the invention.
Figure 5:
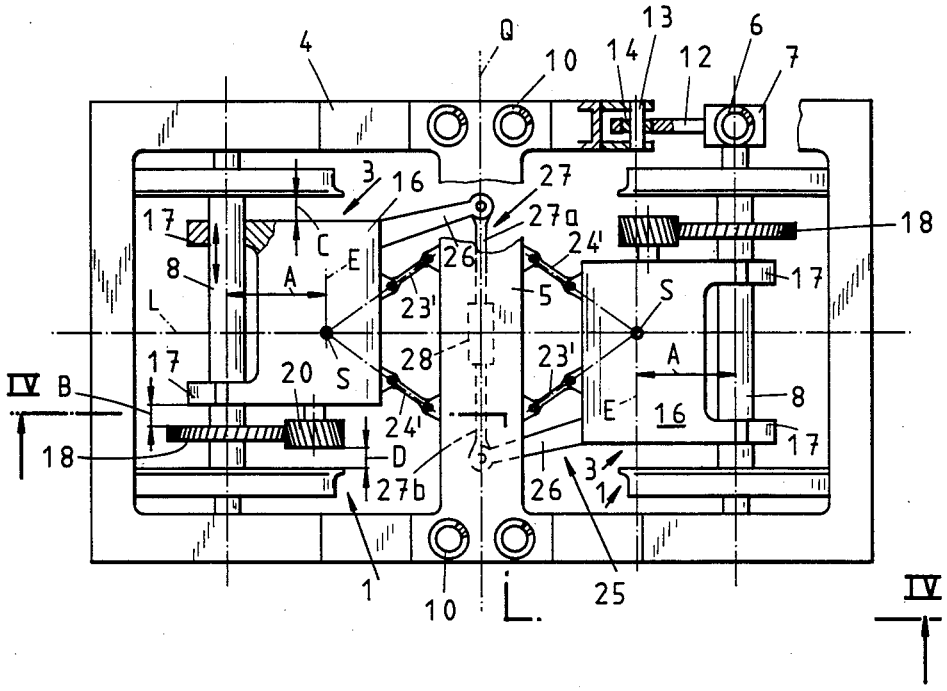
FIG. 5 illustrates a plan view of the traction bogie of FIG. 4.

Referring to FIGS. 4 and 5, wherein like reference characters indicate like parts as above, each link 23', 24' which connects the motor casing 16 to the bolster 5 of the bogie frame 4 may be in the form of a bracket 19 which is hinged to the bolster 5 of the bogie frame 4 while being connected to the casing 16 so as to be movable in three directions. In addition, each bracket 19 is constructed to permit vertical loading of the bracket 19. Alternatively, the hinge connection can be provided on the casing 16 while the three-dimensional articulation is provided on the bogie frame 4. Further, the places where the brackets 19 are articulated may include resilient bearing members.

As indicated in FIG. 5, the distance A of the points of intersection S and the axes of the axles 8 can each correspond approximately to the distance between the axis of a corresponding axle 8 and the transverse plane of the pivot pins 13. Consequently, each imaginary vertical axis determined by a point of intersection S can be disposed in the transverse plane E of the pivot pins 13. In this construction, particularly in connection with helical gears 18 and with axle boxes 7 which are guided so to be movable lengthwise of the vehicle relative to the bogie frame 4, lurching of the wheel sets 1, 2 around the imaginary vertical axes, such as is caused by tooth forces of the helical gearing, is eliminated.

Further, the wheel sets 1,2 can be interconnected by a cross-coupling 25 so as to be movable transversely. In this respect, the cross-coupling 25 interconnects the casing 16 to pivot the casing 16 in opposite directions about the respective vertical axes thereof in response to pivoting of at least one of the wheels sets 1, 2. As shown, the cross-coupling includes a pair of arms or members 26 which are fixed to the respective casings 16 on facing sides and which extend toward the transverse center plane Q and a cross-link 27 which is articulated to an between the members 26. Should the vehicle negotiate a curve, rotation of either wheel set 1 or 2 around the imaginary vertical axis passing through the point of intersection S produces a corresponding and opposite rotation of the other wheel set 2 or 1, respectively around the imaginary axis thereof. Consequently, the two axles 8 of the wheel sets 1, 2 can take up a substantially radial position relative to the curve being negotiated.

The cross-link can be a unitary member or, as shown in FIG. 5, may comprise two parts 27*a*, 27*b* which are so interconnected by a spring element 28 as to be transversely resilient. In association with a unitary rigid cross-link 27, one of the members 26 or the connection between one of the members 26 and the cross-link 27 can be correspondingly resilient so that when the vehicle is negotiating a curve, the wheel sets interconnected by the cross-coupling 25 can make correspondingly compensating movements.

As in the case of the hangers 21, links 23, 24, 23', 24' and guide members 12, the places where the cross-link 27 is articulated may have provision enabling the cooperating parts to move in three dimensions.

Figure 6:
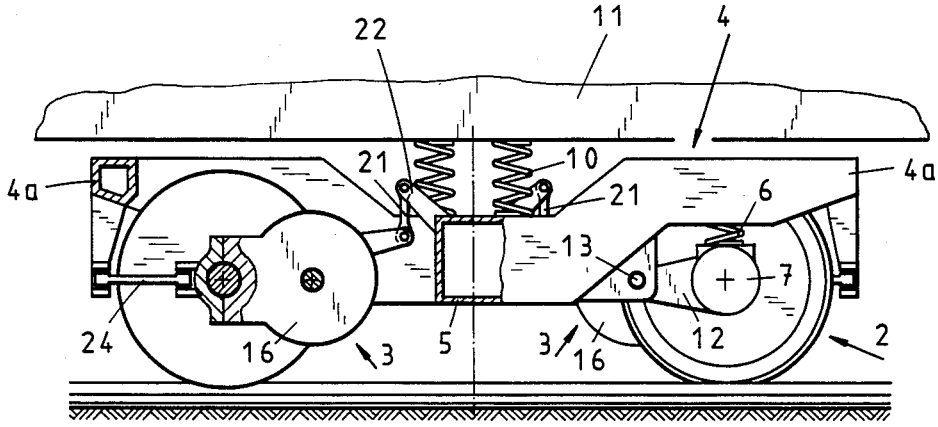
FIG. 6 illustrates a view taken on line VI—VI of FIG. 7 of a further modified traction bogie constructed in accordance with the invention.
Figure 7:
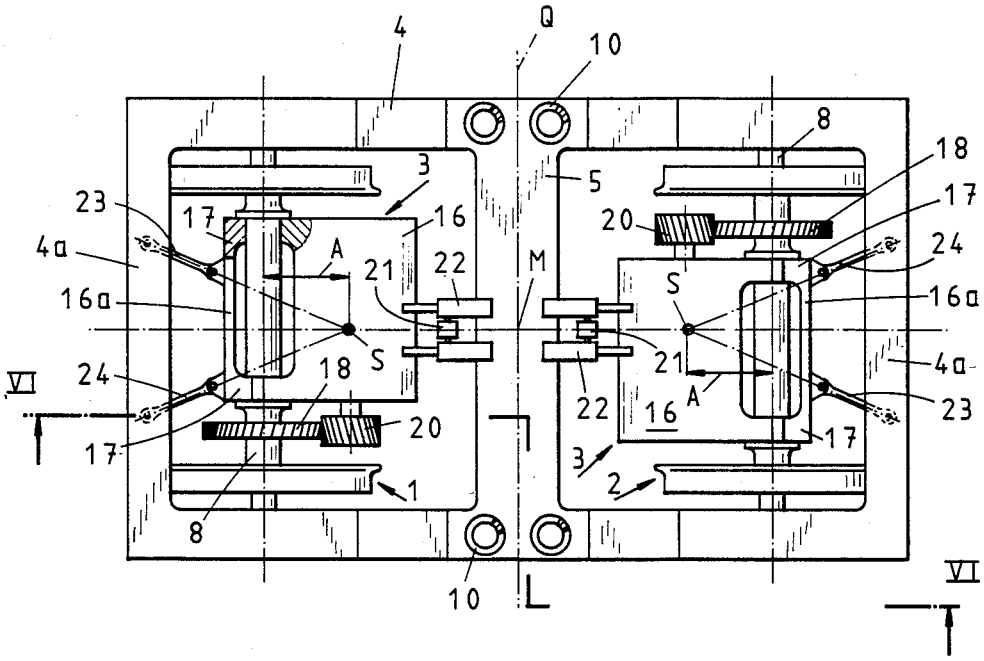
FIG. 7 illustrates a plan view of the bogie of FIG. 6.

Referring to FIGS. 6 and 7, wherein like reference characters indicate like parts as above, the converging links 23, 24 can be articulated to end supports 4*a* on the bogie frame 4 and to those parts 16*a* of the motor casing 16 which are near the supports 4*a*. According to the construction illustrated, the casing part 16*a* can interconnect the bearings 17 of the casing 16.

Figure 8:
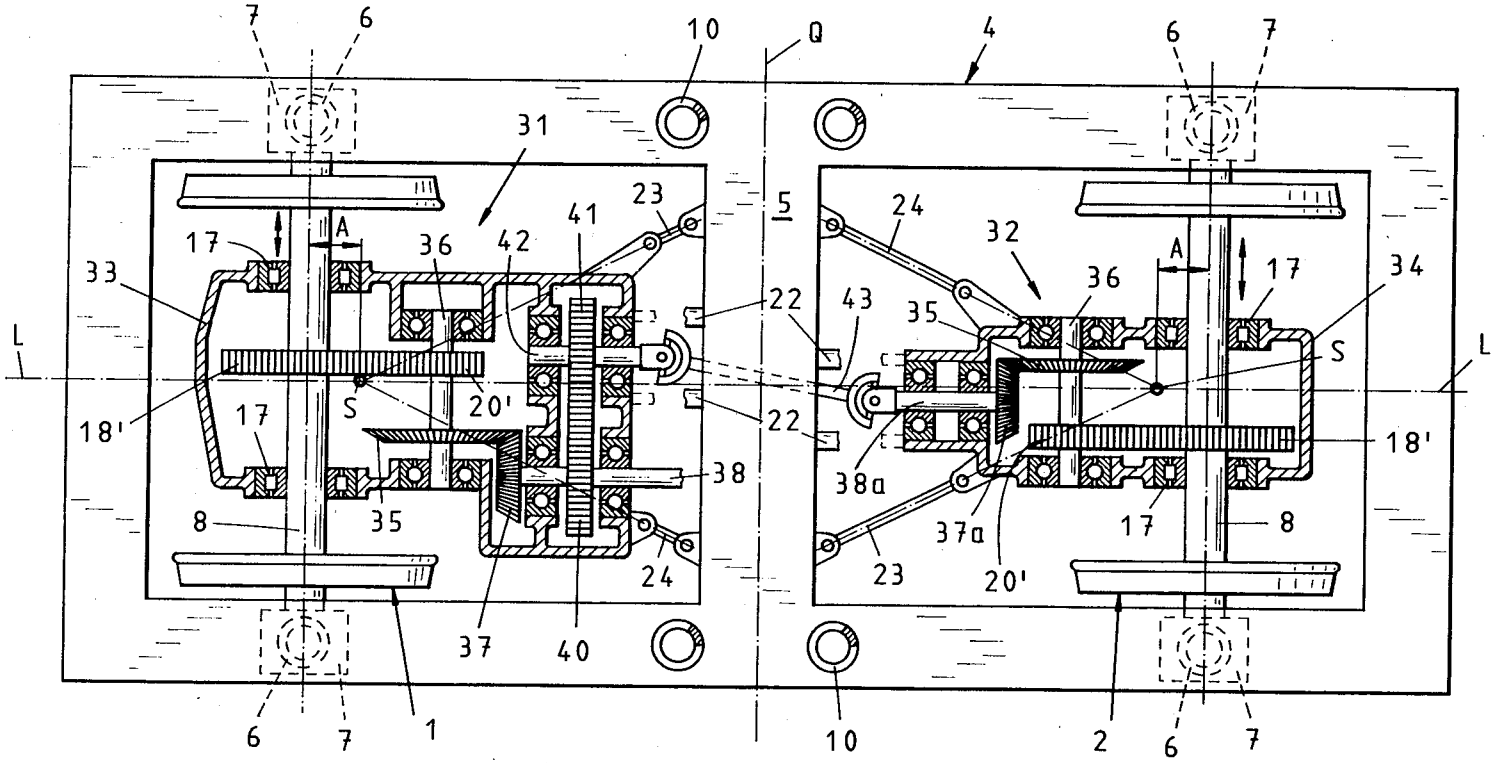
FIG. 8 illustrates a plan view with a partial horizontal sectional view substantially at the height of the wheel set axles of a traction bogie constructed in accordance with the invention.

Referring to FIG. 8, wherein like reference characters indicate like parts as above, instead of mounting traction motors directly on the axles 8, the casings may be in the form of gearboxes 31, 32 which house a transmission for coupling each respective axle 8 to a traction motor (not shown) disposed on the vehicle body. In this case, each gearbox 31, 32 has a casing 33, 34 which is suspended on the brackets 22 of the bolster 5 by way of a pendulum hanger (not shown) while being carried on the corresponding axle 8 by way of axially movable bearings 17. In addition, each casing 33, 34 is operatively coupled by the converging links 23, 24 with the bogie frame 4 with provision for movement lengthwise of the bogie.

As illustrated, each gearbox 31, 32 includes a gear 18' which is secured to an axle 8 and a pinion 20' which meshes with the gear 18' and which is secured with a bevel gear 35 on a common shaft 36 mounted in the casing 33, 34 , respectively. The tooth systems of the gears 18', 20' are such as to permit relative axial movements between them. Each bevel gear 35 meshes with a bevel gear 37, 37*a* disposed on a respective shaft 38, 38*a* disposed in the respective casing 33, 34.

The gearbox 31 also has reverse gearing comprising a gear 40 on the shaft 38 and a gear 41 on a shaft 42. A universal shaft 43 connects the shaft 42 to the shaft 38*a* of the other gear box 32. The shaft 38 is coupled, for example by way of another universal shaft (not shown) with the shaft of a traction motor (not shown) which provides the drive for the two wheel sets 1, 2.

Instead of using pendulum hangers, other means, such as rubber/metal composite elements having longitudinal and transverse resilience, may also be provided to carry the weight and to act as a torque bar for the traction system.

The invention thus provides a traction bogie of simplified construction wherein the wheel sets are able to automatically adjust themselves on curves so as to be positioned substantially radially to the curves without the need for any control facilities, particularly control facilities which are actuated independently.

What is claimed is:

1. A traction bogie for a rail vehicle comprising at least two wheel sets, each wheel set having an axle connecting at least two wheels;

a plurality of axle boxes, each box being disposed on a respective end of a respective axle;

a bogie frame resiliently mounted on said axle boxes for movement at least lengthwise of the bogie;

a pair of casings, each casing being mounted on said axle of a respective wheel set and having means therein for transmitting a driving force to said axle; and a pair of articulated linkages connecting said casings to said bogie frame to transmit a driving force from said wheel sets to said bogie frame; each linkage including at least a pair of links disposed on opposite sides of a longitudinal axis of said bogie frame and in converging relation to each other towards a respective wheel set, each said pair of links having the imaginary extensions of the longitudinal axis of each link thereof intersecting each other at a point of intersection disposed in the vicinity of said respective wheel set and said casing thereon, each said link being articulated at one end to said bogie frame and at an opposite end to a respective casing for pivoting about a vertical axis.

2. A traction bogie as set forth in claim 1 wherein said means in each casing includes a traction motor.

3. A traction bogie as set forth in claim 1 wherein said means in each casing includes a transmission for coupling each respective axle to a traction motor.

4. A traction bogie as set forth in claim 1 wherein said point of intersection is disposed on said longitudinal axis of said bogie frame.

5. A traction bogie asset forth in claim 1 wherein each link is a bracket having at least one end hinged to one of said bogie frame and a respective casing to permit vertical loading of said bracket.

6. A traction bogie as set forth in claim 1 wherein each pair of links is disposed in a common horizontal plane with a respective axle of an adjacent wheel set.

7. A traction bogie as set forth in claim 1 which further comprises a plurality of guide members for coupling said axle boxes to said bogie frame, each guide member being connected at one end to a respective axle box of a respective wheel set and being articulated to said bogie frame about a horizontal axis in a transverse plane parallel to and spaced from a respective axle of said respective wheel set.

8. A traction bogie as set forth in claim 7 wherein said point of intersection of a respective pair of links is disposed between said transverse plane and said respective axle.

9. A traction bogie as set forth in claim 1 which further comprises a cross-coupling interconnecting said casings to pivot said casings in opposite directions about vertical pivot axes thereof in response to pivoting of at least one of said wheel sets.

10. A traction bogie as set forth in claim 9 wherein said cross-coupling includes a pair of members and a cross-link articulated to and between said members, each said member being fixed to a respective casing.

11. A traction bogie for a rail vehicle comprising at least one wheel set having a transverse axle;

a pair of axle boxes, each box being disposed on a respective end of said axle;

a bogie frame resiliently mounted at one end on said axle boxes for at least longitudinal movement thereof;

a casing mounted on said axle and having means therein for transmitting a driving force to said axle; and an articulated linkage connecting said casing to said bogie frame to transmit a driving force from said wheel set to said bogie frame, said linkage including a pair of links on opposite sides of a longitudinal axis of said bogie frame and in converging relation to each other towards said wheel set, said links having an imaginary point of intersection disposed within the plane of at least one of said axle and said casing, each said link being articulated at one end to said bogie frame and at an opposite end to said casing for pivoting about a vertical axis.

12. A traction bogie as set forth in claim 11 wherein said point of intersection is disposed on said longitudinal axis of said bogie frame.

13. A traction bogie as set forth in claim 11 wherein said pair of links is disposed in a common horizontal plane with said axle.

14. A traction bogie as set forth in claim 11 which further comprises a pair of guide members, each guide member being connected at one end to a respective axle box and at an opposite end to said bogie frame about a horizontal axis in a transverse plane parallel to and spaced from said axle.

15. A traction bogie as set forth in claim 14 wherein said point of intersection is disposed between said transverse plane and a longitudinal axis of said axle.

16. A traction bogie as set forth in claim 14 wherein each guide member is resiliently connected to said bogie frame for universal movement.

17. A traction bogie for a rail vehicle comprising at least two wheel sets, each wheel set having an axle connecting at least two wheels;

a plurality of axle boxes, each box being disposed on a respective end of a respective axle;

a bogie frame resiliently mounted on said axle boxes for movement at least lengthwise of the bogie;

a pair of casings, each casing being mounted on said axle of a respective wheel set and having means therein for transmitting a driving force to said axle; and a pair of articulated linkages connecting said casings to said bogie frame to transmit a driving force from said wheel sets to said bogie frame; each linkage including at least a pair of links disposed on opposite sides of a longitudinal axis of said bogie frame and in converging relation to each other towards a respective wheel set, each said pair of links having the imaginary extensions of the longitudinal axis of each link thereof intersecting each other at a point of intersection disposed in the plane of at least one of said respective wheel set and said casing thereon, each said link being articulated at one end to said bogie frame and at an opposite end to a respective casing for pivoting about a vertical axis.

* * * * *

UNITED STATES PATENT AND TRADEMARK OFFICE

CERTIFICATE OF CORRECTION

PATENT NO. : 4,787,318

DATED : Nov. 29, 1988

INVENTOR(S) : HANS H. VOGEL

It is certified that error appears in the above-identified patent and that said Letters Patent is hereby corrected as shown below:

Column 1, line 53 "a axle" should be -an axle-
Column 2, line 53 "frame,,and" should be -frame, and-
Column 2, line 67 cancel "which"
Column 4, line 53 "is" should be -are-
Column 5, line 41 "an" should be -and-
Column 7, line 11 "asset" should be -as set- Signed and Sealed this Fifteenth Day of August, 1989

*Attest:*

DONALD J. QUIGG

*Attesting Officer*

*Commissioner of Patents and Trademarks*